US011497298B1

(12) United States Patent
Audlee

(10) Patent No.: US 11,497,298 B1
(45) Date of Patent: Nov. 15, 2022

(54) WEARABLE PORTABLE SYSTEM FOR CARRYING AND STORING AN OBJECT

(71) Applicant: Rosenilda Furtado Audlee, Stoughton, MA (US)

(72) Inventor: Rosenilda Furtado Audlee, Stoughton, MA (US)

( * ) Notice: Subject to any disclaimer, the term of this patent is extended or adjusted under 35 U.S.C. 154(b) by 0 days.

(21) Appl. No.: 17/359,696

(22) Filed: Jun. 28, 2021

(51) Int. Cl.
*A45F 5/02* (2006.01)
*A45F 5/00* (2006.01)

(52) U.S. Cl.
CPC ..... *A45F 5/00* (2013.01); *A45F 2005/008* (2013.01)

(58) Field of Classification Search
CPC ..... A45F 2005/008; A44C 5/2071; Y10S 206/818; B62B 29/02
USPC ..... 224/183
See application file for complete search history.

(56) References Cited

U.S. PATENT DOCUMENTS 1,609,481 A * 12/1926 McCarthy ..... A44C 5/003 132/294
4,325,504 A 4/1982 Amani
4,826,059 A 5/1989 Bosch et al.
D317,730 S 6/1991 Mo
5,148,916 A * 9/1992 Tillyer, Sr. ..... A45C 13/02 206/472
5,201,444 A 4/1993 Simonet
5,333,767 A 8/1994 Anderson
D364,955 S 12/1995 Gringer et al.
5,593,073 A 1/1997 Finnegan
6,213,365 B1 * 4/2001 Stocke ..... A41D 13/0012 224/684
6,227,424 B1 * 5/2001 Roegner ..... A45C 1/04 224/222
6,330,961 B1 * 12/2001 Borja ..... H04B 1/385 224/267
6,496,094 B2 12/2002 May, III
10,206,463 B2 2/2019 Jong
11,033,082 B1 * 6/2021 Riot ..... A44C 5/147
2006/0016841 A1 1/2006 Shurm
2006/0201595 A1 * 9/2006 Carmichael ..... A45C 1/04 206/83
2008/0110951 A1 * 5/2008 Lauri ..... A45F 5/02 224/183
2009/0050657 A1 2/2009 Woolery
2010/0116697 A1 * 5/2010 Gonazlez ..... B42F 7/14 220/500
2017/0035184 A1 * 2/2017 Sagel ..... A45D 33/008
2021/0251350 A1 * 8/2021 Diercks ..... A44C 5/003

* cited by examiner

*Primary Examiner* — Adam J Waggenspack
(74) *Attorney, Agent, or Firm* — Howard University School of Law

(57) ABSTRACT

A wrist mounted object blade holding device provides safe open access to an object, such as a blade, for construction purposes and other purposes. The device provides for a storage compartment for post-construction activities and other activities. A carrier and storage apparatus housed in the center of an adjustable band may include a double sided centralized magnetic strip, with an upper portion safety guard rail perimeter and a lower portion storage compartment.

20 Claims, 4 Drawing Sheets

WEARABLE PORTABLE SYSTEM FOR CARRYING AND STORING AN OBJECT

FIELD

The present disclosure relates generally to a wearable portable system for carrying and storing a razor blade for construction purposes.

BACKGROUND

Often in construction work employees are required to carry around a straight edge razor blade to complete construction related activities such as but not limited to surface scrapping, paint removal, and putty spreading. Due to the frequent volume of such activities, construction workers find it desirable to have razor blade easily accessible at all times. However, the clear hazardous nature of razor blade known for its particularly sharp edges and surfaces presents significant accessibility issues. This is particularly true when a sequence of construction related activities are being performed that require concentration, or when the construction activities take place in locations that require additional attentiveness for safety such as on a ladder, on a building, or in confined and narrow places.

In such situations the particular activity that can pose significant danger to the carrier. The lack of efficient transport methods while working often leave construction workers without a proper place to carry or hold the razor. This often results in workers utilizing unsafe measures such as holding the razor blades with their teeth, storing the razor blade in pockets, or on open face holders, all of which frequently result in injury. The razor blade additionally poses storage difficulties. Due to a razor blades small size and sharp nature, storage in bags and purses result in frequent misplacement of the object which poses significant danger when locating the blade.

SUMMARY

In light of the foregoing background, the following presents a simplified summary of the present disclosure to provide a basic understanding of some aspects of the disclosure. This summary is not an extensive overview of the disclosure. It is not intended to identify key or critical elements of the disclosure, or to delineate the scope of the disclosure. The following summary merely presents some concepts of the disclosure in a simplified form as a prelude to the more detailed description provided below.

In one aspect, the present disclosure provides a wrist wearable device for holding an object therein, the wearable device comprises a double layered storage container including an upper compartment, a left side, a right side and a lower compartment; a double-sided magnet housed in middle of the upper compartment and the lower compartment of the storage container; and a set of adjustable bands located on the left side and the right side of the storage container adapted for mounting the wearable device on a wrist of a human wearer.

In one aspect, the present disclosure provides a razor magnetic holding device which may be attached to a user's lower arm or wrist. The razor holding compartment may be a dual sided casing composed of plastic material located in a center of the two adjustable straps consisting of an open-faced superior portion with a detachable safety cover and a closed/storage inferior portion. The superior portion of the compartment consists of a plastic guard rail along the lateral and posterior perimeter of the surface. The inferior portion of the compartment consists of a plastic casing with a sealable cover. A bilateral or double sided magnet strip may be located in the center portion of the compartment.

In one aspect, the top side of the magnet strip may be located in the superior portion of the compartment holding the razor in place during construction activities. The back side of the magnet strip is located in the center of the inferior storage compartment holding the magnet in place during storage.

BRIEF DESCRIPTION OF THE DRAWINGS

The foregoing summary as well as the following detailed description, considered in conjunction with the accompanying drawings, provide a better understanding of the disclosure, in which like reference numbers refer to like elements, and wherein.

DETAILED DESCRIPTION

Figure 1:
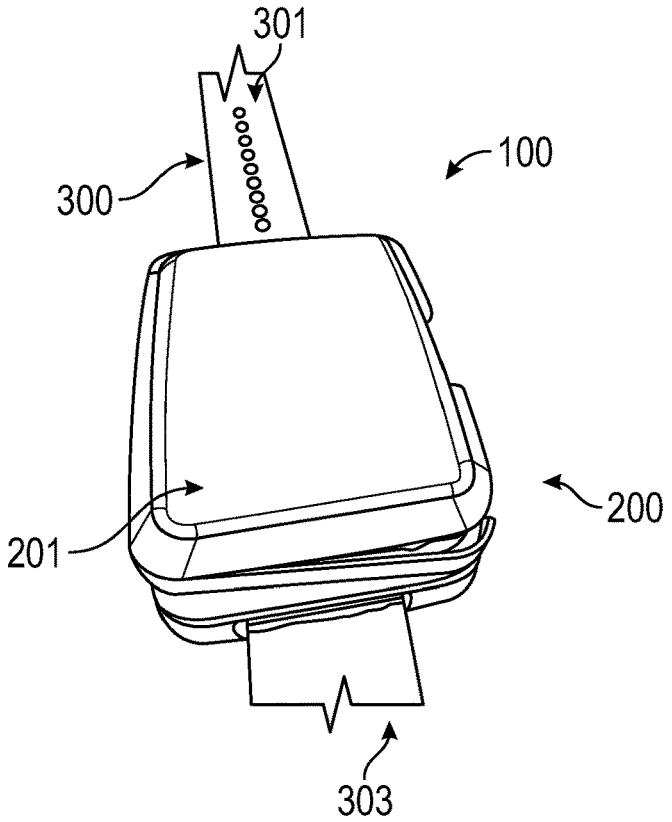
FIG. 1 is a top perspective view of a wearable device for razor holding as per an aspect of an embodiment of the present disclosure.

The accompanying drawings, which form a part hereof, show examples of the disclosure. It is to be understood that the examples shown in the drawings and/or discussed herein are non-exclusive and that there are other examples of how the disclosure may be practiced.

Figure 2:
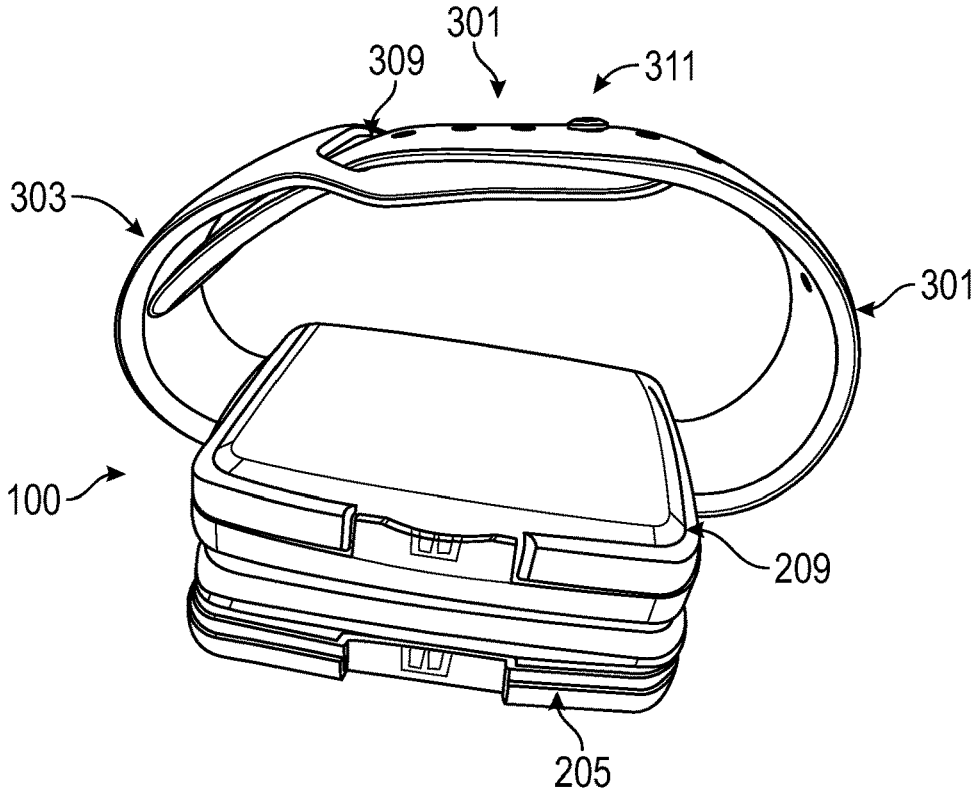
FIG. 2 is a bottom perspective view of the wearable device as per an aspect of an embodiment of the present disclosure.
Figure 3:
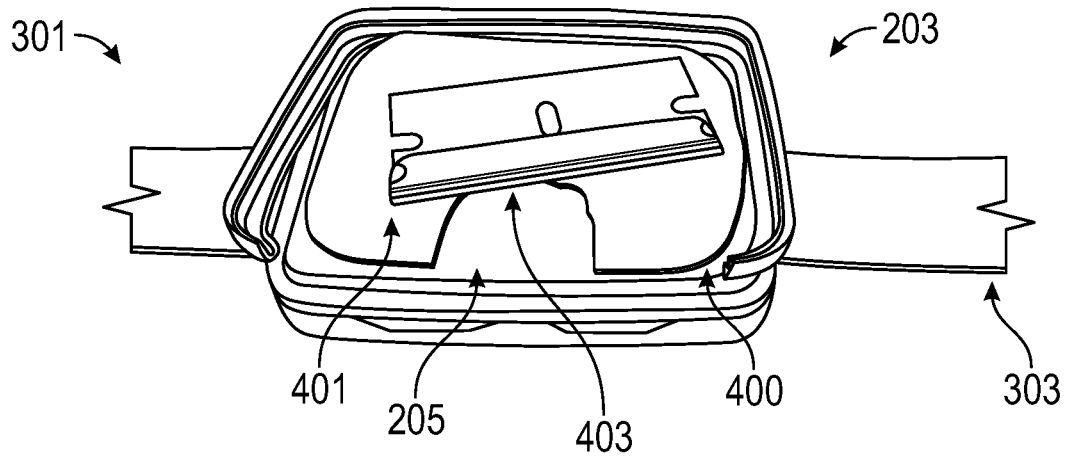
FIG. 3 is a perspective view of the wearable device with a razor housing compartment located in the center of an adjustable band, with a double-sided magnetic device housed in the center of the compartment, and a border guard rail surrounding the magnetic device as per an aspect of an embodiment of the present disclosure.
Figure 4:
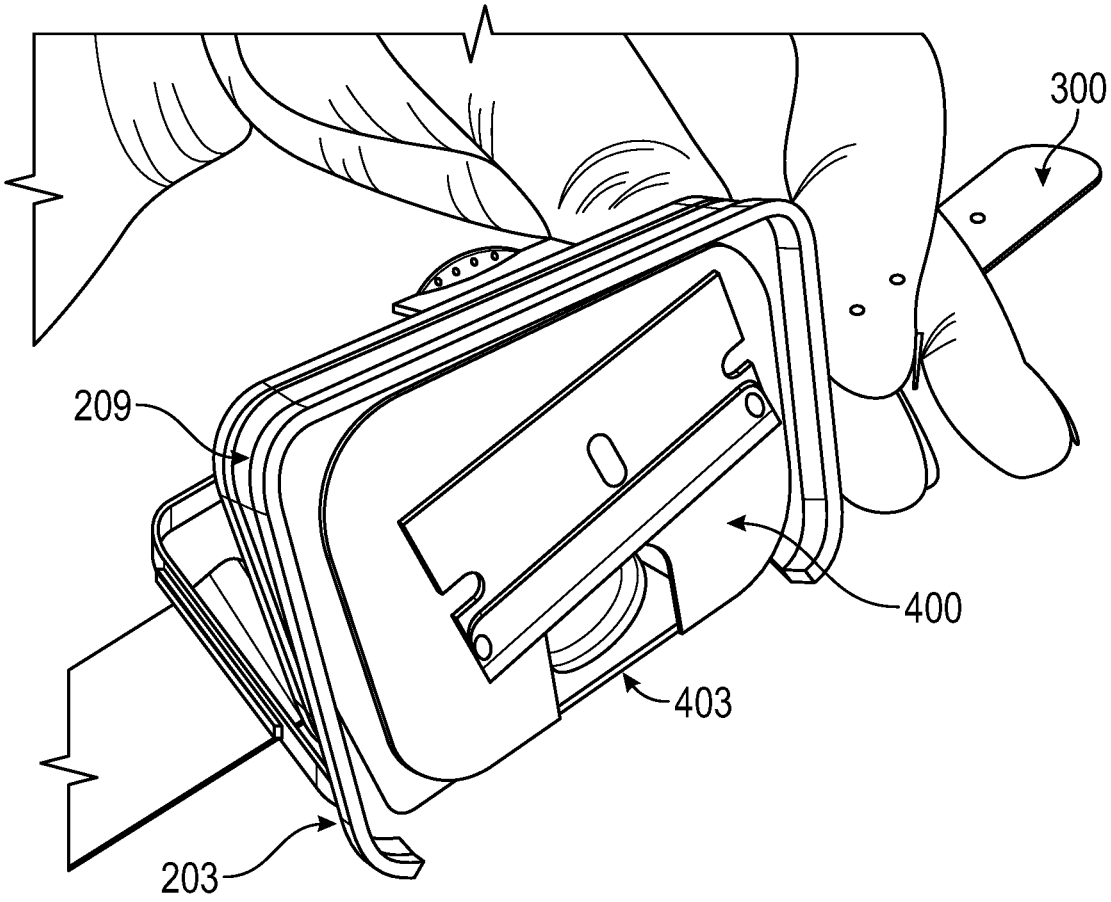
FIG. 4 is a top perspective view of the openable razor housing compartment, with the dual sided magnetic device located in the center of the compartment, and the storage compartment located at the bottom as per an aspect of an embodiment of the present disclosure.

FIGS. 1-8 illustrative various features of a wearable device 100 for holding a razor blade or other thin device, such a key. Referring to FIG. 3, a wrist mounted holding device 100 may include a storage container 200, a set of adjustable bands 300 and a double-sided magnet 400. Referring to FIG. 3, the container 200 is a double layered storage container housing the double-sided magnet 400 for carrying and storing a razor blade, for example. The adjustable band 300 is configured for the user to wear the double layered storage container 200 around the wrist or lower arm. The magnetic 400 is a double side magnetic device that holds a razor blade or magnetic key in place during use.

Referring to FIG. 2, the adjustable band 300 is a wearable device that may be attached on the lower arm of the user. It would be readily apparent to those skilled in the art that the adjustable band 300 may be used to attach to other parts of the user such as legs, arms, thighs, etc. without deviating from the scope of the present disclosure.

Referring to FIG. 1, the storage container 200 is a multi-layered holding system housed in the center of the adjustable band 300. The wearable device 100 further includes a safety lid 201 also termed as container lid 201. The container lid 201 is a detachable safety lid that is used to cover the upper layer of the storage container 200.

Referring to FIG. 2, the storage container 200 is located in the center of a set of adjustable bands 300. The set of adjustable bands 300 having a right side 301 and a left side 303. The right side 301 of the adjustable band 300 has a series of apertures 307 along the length of the band 300. a metal fastener 311 is located at the end of the left side 303 of the adjustable band 300. The fastener 311 fits into apertures 307 on the right side 301 of the band 300 to allow the user to adjust the size of the band to fit the wrist or lower arm. This allows the user to easily transport the razor blade or other thin object during construction while keeping both hands free to focus on other construction activities. Referring to FIG. 2, the storage container 200 comprises an upper compartment 205 and a lower compartment 209. The storage container 200 comprises a small rectangular shape that is light and size allowing for it be easily transported by the user or wearer.

Referring to FIG. 3, the upper compartment 205 serves as a housing mechanism for a magnet 400 located in the center of the container 200. The upper compartment 205 has a guard rail 203 along the side and back perimeter of the compartment 205, The guard rail 203 serves as safety measure for the user by preventing the razor blade from sliding back and forth and injuring the user while the razor blade is not being used. The guard rail 203 is made of a plastic material and has the height of about a centimeter.

Referring to FIG. 3, the magnetic 400 is doubled sided magnet located in the middle of the upper compartment 205 and the lower compartment 209 of the storage container 200. The magnet 400 uses a magnetic force to hold a metal razor blade or key in place during construction activities, for example. The magnet 400 is a thin flat sleek device comprising a square shape with a crescent shape indention on bottom side 403. The crescent indention 403 allows the user to place their thumb in the indention and safely remove the razor from the flat magnetic surface whenever it is needed.

Figure 5:
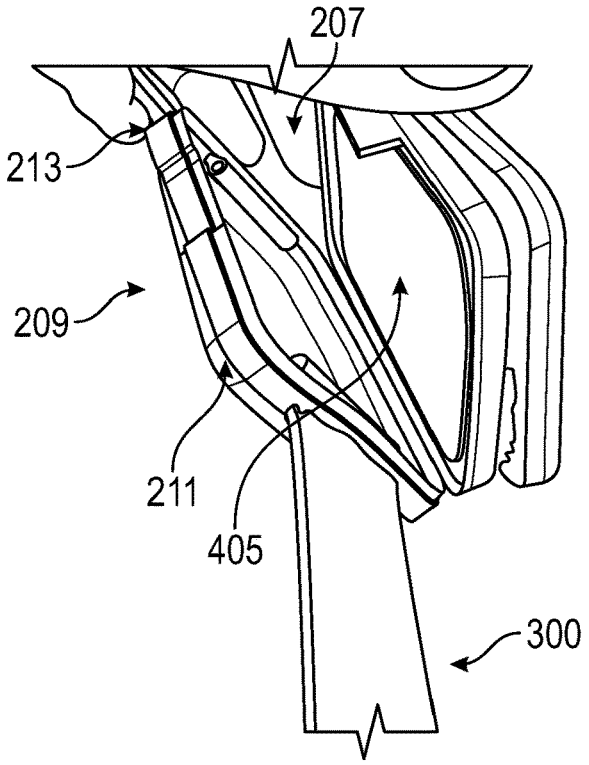
FIG. 5 is a bottom perspective view of the openable razor housing compartment, with the bottom portion of the magnetic side located in the center of the top portion of the storage compartment, and the adjustable straps adhesively attached internally in the inferior portion of the plastic casing holding the plastic compartment in place as per an aspect of an embodiment of the present disclosure.

Referring to FIG. 5, the upper compartment 205 dually acts as flip top mechanism that may be opened by the user to reveal the lower compartment 209. The lower compartment 209 serves a storage mechanism allowing the user to place the razor blade in the compartment for safe keeping once construction activities are completed.

Figure 6:
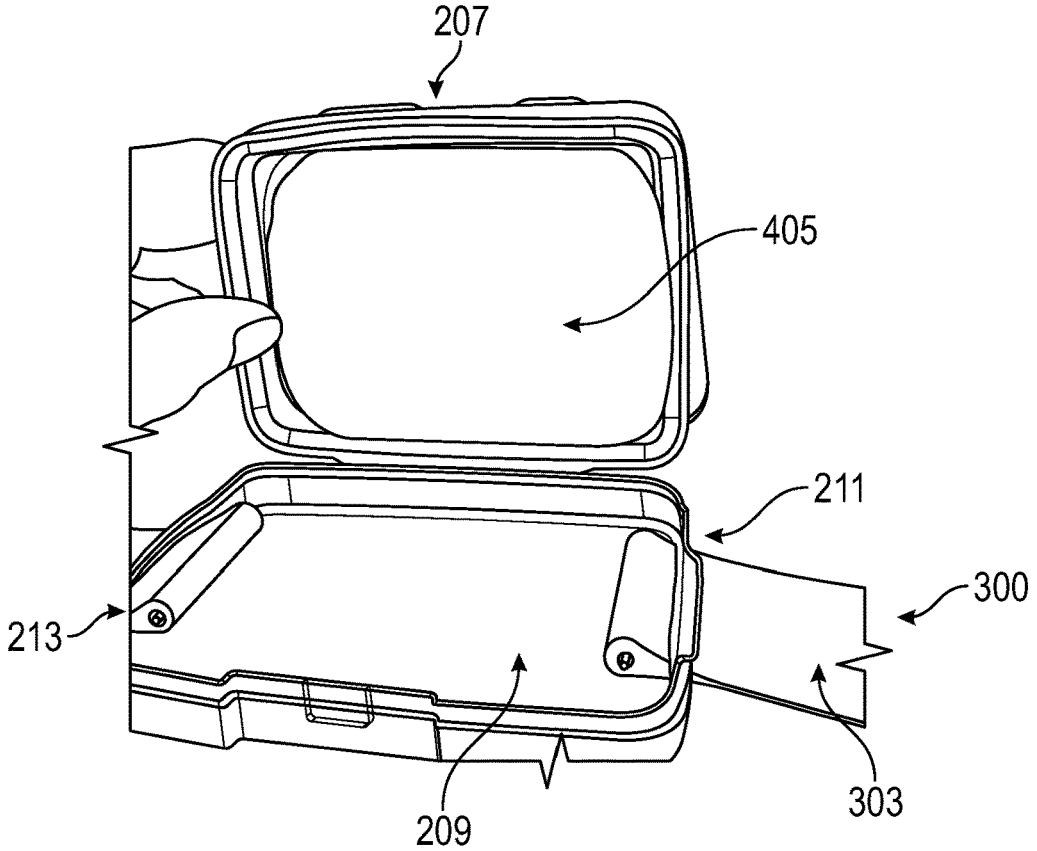
FIG. 6 is a front perspective view of the openable razor housing compartment, showing the bottom storage compartment of the device, with the dual magnetic device centered in the upper portion of the device, and the plastic storage compartment at the bottom.

Referring to FIG. 6, the adjustable bands 300 are located on the right and left side of the storage container 200. The right band 301 is attached to the container 200 through an adhesive material by sliding the band into a small slit on the right side of the lower compartment 209 of the container. The left band 303 is attached to the container 200 by an adhesive material by sliding the band into small cut out portion on the left side of the lower compartment 209.

Figure 7:
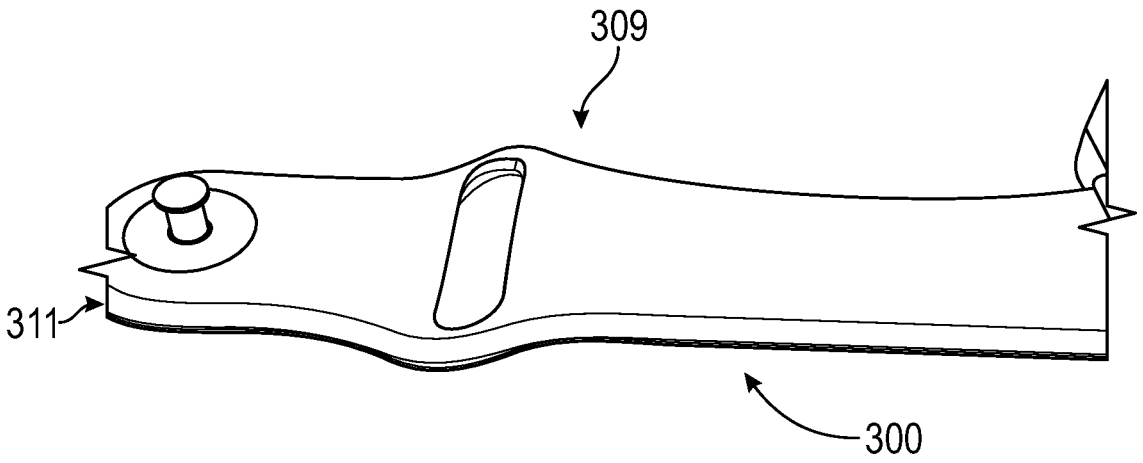
FIG. 7 shows a perspective view of left side of the adjustable band, with the metal fastener that slides into the apertures located on the opposing side, and the slit that holds the excess portion of the adjustable band as per an aspect of an embodiment of the present disclosure.

Referring to FIG. 7, the left adjustable band 303 has a metal fastener located on the end of the band 311. The fastener 311 is made up of a metal material. A circular slit 309 is located on the left band 303 and serves to hold the excess portion of the band once fastened to provide a sleek fit. It would be readily apparent to those skilled in the art that various materials for the fastener 311 may be envisioned without deviating from the scope of the present disclosure.

Figure 8:
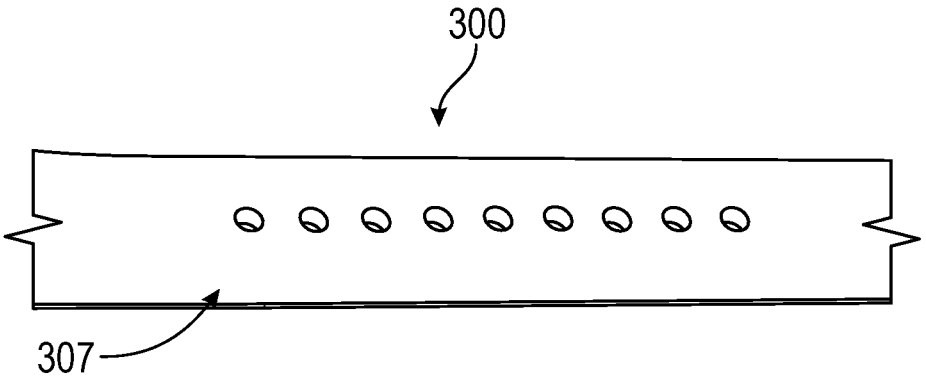
FIG. 8 is a perspective view of right side of the adjustable band of the wearable device, with apertures for securement located along the length of the band as per an aspect of an embodiment of the present disclosure.

Referring to FIG. 8, the right adjustable band 301 has a series of apertures 307 along the length of the band. The apertures 307 comprise a circular shape. It would be readily apparent to those skilled that various shapes of the apertures 307 may be envisioned without deviating from the scope of the present disclosure.

While various embodiments have been described above, it should be understood that they have been presented by way of example, and not limitation. It will be apparent to persons skilled in the relevant art(s) that various changes in form and detail can be made therein without departing from the spirit and scope. In fact, after reading the above description, it will be apparent to one skilled in the relevant art(s) how to implement alternative embodiments. Thus, the present embodiments should not be limited by any of the above-described exemplary embodiments.

In addition, it should be understood that the figures, which highlight the functionality and advantages of the present invention, are presented for example purposes only. The architecture of the present invention is sufficiently flexible and configurable, such that it may be utilized in ways other than that shown in the accompanying figures and algorithms. For example, the steps listed in any flowchart may be re-ordered or only optionally used in some embodiments.

It should be noted the terms "including" and "comprising" should be interpreted as meaning "including, but not limited to".

In this specification, "a" and "an" and similar phrases are to be interpreted as "at least one" and "one or more." References to "the," "said," and similar phrases should be interpreted as "the at least one", "said at least one", etc. References to "an" embodiment in this disclosure are not necessarily to the same embodiment.

It is the applicant's intent that only claims that include the express language "means for" or "step for" be interpreted under 35 U.S.C. 112. Claims that do not expressly include the phrase "means for" or "step for" are not to be interpreted under 35 U.S.C. 112.

Further, the purpose of the Abstract of the Disclosure is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract of the Disclosure is not intended to be limiting as to the scope in any way.

What is claimed is:

1. A wrist wearable device for holding an object therein, the wearable device comprising:

a double layered storage container including an upper compartment, a left side, a right side and a lower compartment;

a double-sided magnet housed in the upper compartment and the lower compartment of the storage container; and a set of adjustable bands located on the left side and the right side of the storage container adapted for mounting the wearable device on a wrist of a human wearer.

2. The wearable device according to claim 1, wherein the upper compartment of the storage container has an open face.

3. The wearable device according to claim 2, further comprising a safety lid to be positioned on the storage container.

4. The wearable device according to claim 3, wherein the safety lid further comprising a flip top mechanism attached to the upper compartment.

5. The wearable device according to claim 3, wherein the safety lid is detachably attached to the upper compartment.

6. The wearable device according to claim 2, further comprising a double-sided magnetic plate attached to the upper compartment located in a middle of the open face.

7. The wearable device according to claim 6, wherein the double-sided magnet utilizes magnetic force to hold a magnetic object within the container.

8. The wearable device according to claim 1, wherein the double-sided magnet has a crescent indention for ease of removal of the object.

9. The wearable device according to claim 1, wherein the double-sided magnet has a guard rail around its outer perimeter.

10. The wearable device according to claim 9, wherein the guard rail is adhesively attached to the upper compartment of the container.

11. The wearable device according to claim 9, wherein the guard rail serves as a safety device to prevent a wearer from cutting themselves from a razor blade.

12. The wearable device according to claim 4, wherein the upper compartment flip top mechanism opens to reveal the lower compartment.

13. The wearable device according to claim 12, wherein the lower compartment serves as a storage area for a flat object.

14. The wearable device according to claim 12, wherein the adjustable bands attached adhesively on left and right side of the lower compartment of the container.

15. The wearable device according to claim 1, wherein the adjustable band contains apertures along the length of the band on the right side of the container.

16. The wearable device according to claim 14, wherein the adjustable band comprises a fastener and a small slit located on left side of the container.

17. The wearable device according to claim 15, wherein the fastener fits securely into the apertures to provide an adjustable fit to the wearer.

18. The wearable device according to claim 16, wherein the small slit houses the excess portion of the adjustable band after being fastened.

19. The wearable device according to claim 1, wherein the adjustable bands are comprised of a rubber material.

20. The wearable device according to claim 17, wherein the fastener is comprised of a metal material.

* * * * *